US007880754B2

(12) United States Patent
Kunde

(10) Patent No.: US 7,880,754 B2
(45) Date of Patent: Feb. 1, 2011

(54) THERMOTRANSFER PRINTER, AND METHOD FOR CONTROLLING ACTIVATION OF PRINTING ELEMENTS OF A PRINT HEAD THEREOF

(75) Inventor: Christoph Kunde, Berlin (DE)

(73) Assignee: Francotyp-Postalia GmbH (DE)

( * ) Notice: Subject to any disclaimer, the term of this patent is extended or adjusted under 35 U.S.C. 154(b) by 1045 days.

(21) Appl. No.: 11/290,301

(22) Filed: Nov. 30, 2005

(65) Prior Publication Data

US 2006/0140701 A1 Jun. 29, 2006

(30) Foreign Application Priority Data

Nov. 30, 2004 (DE) ..... 10 2004 060 156

(51) Int. Cl.
*B41J 2/00* (2006.01)

(52) U.S. Cl. ..... 347/188; 347/195

(58) Field of Classification Search ..... 347/188, 347/180, 189, 190, 191, 192, 193, 194, 195, 347/88, 99, 177, 213, 214, 215, 217
See application file for complete search history.

(56) References Cited

U.S. PATENT DOCUMENTS 4,415,907 A 11/1983 Suemori
4,507,668 A * 3/1985 Horiya et al. ..... 347/193
4,540,991 A * 9/1985 Kariya et al. ..... 347/191
4,901,090 A 2/1990 Ozawa et al.
5,079,565 A 1/1992 Shimizu et al.
5,400,058 A 3/1995 Helmbold et al.
5,497,450 A * 3/1996 Helmbold et al. ..... 358/1.15
5,534,890 A * 7/1996 Krug et al. ..... 346/100
5,546,113 A * 8/1996 Izumi ..... 347/195
5,625,399 A * 4/1997 Wiklof et al. ..... 347/195
5,661,512 A * 8/1997 Fukuda et al. ..... 347/175
5,765,953 A * 6/1998 Takahashi ..... 400/120.09
5,777,652 A * 7/1998 Takeuchi ..... 347/171
5,798,789 A * 8/1998 Ono et al. ..... 347/186
5,812,156 A * 9/1998 Bullock et al. ..... 347/19
5,821,975 A * 10/1998 Gunther et al. ..... 347/217
5,946,020 A * 8/1999 Rogers et al. ..... 347/193

(Continued)

FOREIGN PATENT DOCUMENTS

DE 40 26 896 A1 2/1992

(Continued)

*Primary Examiner*—Stephen D Meier
*Assistant Examiner*—Leonard S Liang
(74) *Attorney, Agent, or Firm*—Schiff Hardin LLP

(57) ABSTRACT

In a method for activation of a print head operating according to the thermotransfer principle, the print head having a number of printing elements, in which the energy quantity to be supplied to a printing element is determined in a determination step, and the energy quantity is supplied to the printing element in a supply step in order to transfer ink from an ink carrier device associated with the print head onto a substrate associated with the ink carrier device. A print parameter set characteristic of the ink carrier device is read from a memory associated with the ink carrier device in a read step preceding the determination step and the energy quantity is determined in the determination step using at least the print parameter set.

26 Claims, 3 Drawing Sheets

U.S. PATENT DOCUMENTS 5,949,467 A * 9/1999 Gunther et al. ..... 347/214
5,999,204 A * 12/1999 Kojima ..... 347/194
6,023,284 A * 2/2000 Rogers et al. ..... 347/217
6,088,048 A * 7/2000 Soshi ..... 347/188
6,108,019 A * 8/2000 Katsuma et al. ..... 347/188
7,264,323 B2 * 9/2007 Tainer et al. ..... 347/11

FOREIGN PATENT DOCUMENTS

JP 08001969 A * 1/1996
JP 2001105648 A * 4/2001

* cited by examiner

THERMOTRANSFER PRINTER, AND METHOD FOR CONTROLLING ACTIVATION OF PRINTING ELEMENTS OF A PRINT HEAD THEREOF

BACKGROUND OF THE INVENTION

1. Field of the Invention

The present invention concerns a method for controlling a print head operating with multiple printing elements according to the thermotransfer principle, of the type wherein an energy quantity to be supplied to a printing element in a supply step is determined in a determination step, and the energy quantity is supplied to the printing element in the supply step in order to transfer ink from an ink carrier device associated with the print head onto a substrate associated with the ink carrier device. The present invention furthermore concerns a printer that is suitable for implementation of the inventive method.

2. Description of the Prior Art

To obtain a qualitatively high-grade image in thermotransfer printers of the above general type, each printing element of the print head must be supplied with a relatively precisely quantified energy in order to reliably melt the ink particles from the carrier material of the ink ribbon in the desired quantity, or spatial expanse. Depending on the current temperature of the respective printing element, more or less energy must be supplied in order to achieve the optimal melting temperature.

The control of the printing elements normally is optimized at the manufacturer's factory for a specific ink ribbon type with a specific ink, such that a degradation of the print quality can result given the use of a different ink, as well as possibly in the case of gradual changes of the properties of the ink ribbons that are repeatedly used. If this is the case, conventionally a comparably elaborate adaptation of the firmware of the printed for the control of the printing elements would have to ensue.

SUMMARY OF THE INVENTION

An object of the present invention is to provide a method and a printer of the type described above that do not exhibit, or exhibit to a lesser degree, the disadvantages cited above, and that enable a simple adaptation of the control of the printing elements to changed properties of the ink carrier device.

The present invention is based on the recognition that a simple adaptation of the control of the printing elements to varied properties of the ink carrier device is achieved by reading a parameter set, characteristic of the ink carrier device, from a memory associated with the ink carrier device and by determining the energy quantity using at least this print parameter set.

The association of the memory with the ink carrier device enables the memory to be exchanged together with the ink carrier device in use. Energy parameters precisely matched to the currently-used ink carrier device thus are automatically available for use in a simple manner. Among other things, it is possible to use ink carrier devices with respectively different inks without an elaborate modification of the firmware of the control of the print head being necessary.

The print parameter set that is characteristic for the ink carrier device is read from the memory associated with the ink carrier device in a read step preceding the determination step, and the energy quantity is determined in the determination step using (at least) the first print parameter set.

The memory can be associated with the ink carrier device in an arbitrary manner. It must only be ensured that the memory can be read out by the print head control at or after the association of the ink carrier device with the print head. The print parameter set therefore is preferably read out from the memory in a read step, with the memory arranged on the ink carrier device.

The memory can be an arbitrary memory type that can be read out in any suitable manner. For example, it can be formed by one or more electronic or electromagnetic or optical memory modules etc. Preferably the memory is formed by one or more memory chips that can be contacted and read out via suitable means. Alternatively, it can also be a (preferably suitably coded) marking, the information content of which is detected in an optical manner.

The ink carrier device can likewise be any suitable device with an ink carrier that carries ink in a manner allowing the ink to be separated (released) from the carrier. For example, the ink carrier device can be an ink ribbon cassette with an ink ribbon as the ink carrier.

This ink carrier device can be exchangeable in any suitable manner so as to be removable from the print head. When a new ink carrier device is associated with the print head, for example a new ink (replacement) ribbon cassette is used, as mentioned a connection with the memory is preferably automatically established in order to be able to read out print parameters from the print parameter set. This can ensue, for example, with contact elements on the ink carrier device that are automatically electrically contacted in the mounting of the ink carrier device on the printer.

The print parameter set preferably contains at least one partial parameter set that in turn contains at least one print parameter as a function of at least one state parameter that predominates in the region of the print head. It is hereby possible to quickly and simply react to different states of the printer or its environment, for example to different temperatures or print speeds.

The print parameter can be stored as a continuous function of the appertaining state parameter. In further variants of the inventive method partial parameter set contains multiple discrete values of the state parameter respectively associated with different print parameter values, such that the appertaining print parameter value can be directly extracted from the partial parameter set if necessary without further calculations.

A large number of such value pairs can be provided in order to extract the appertaining print parameter value directly from the partial parameter set with sufficient precision. In order to reduce the storage outlay, preferably intermediate values of the print parameter value are determined by interpolation in the determination step for values of the state parameter lying between the discrete values of the state parameter.

The state parameter can be any state parameter that influences the print event or its result. The state parameter preferably is a temperature in the region of the print head, since this has direct influence on the energy to be expended for the printing. The state parameter can likewise be a relative speed of a medium (for example of a substrate to be printed) with respect to the printing element and/or the ink carrier device. For example, the state parameter can be the feed speed of the medium to be printed or the relative speed between print head and ink carrier, etc.

As explained above, in the print event each printing element must be supplied with a relatively precise energy quantity in order to reliably melt the ink particles from the ink carrier in the desired quantity or spatial expanse. Depending on the current temperature of the printing element, more or less energy thus must be supplied in order to achieve the optimal melting temperature.

If at all, the current temperature of the printing element can be directly determined only with significant effort. Among other things, this temperature depends on the temperature of the surrounding environment of the print head, but it also depends on the energy previously supplied to the respective printing element. In a preferred version of the inventive method, the historical energy supply to the printing element in question, or at least the immediately preceding supply to that element, is taken into account in the determination step. With this involvement of the previous printing history, it is possible to estimate the energy necessary for optimally undertaking the current printing in a simple manner with high precision.

Depending on the control of the printing elements, the determination of the energy necessary for optimal printing can ensue before the printing event, for the entire print image. The energy supply to at least the printing element in question to ensue in at least one supply step preceding the current supply step is then accounted for in the determination step. If the determination of the energy necessary for optimal printing ensues during the printing event, the previous supply to the printing element that has ensued in at least one preceding supply step is then accounted for in the determination step.

It can suffice to account only for the printing element in question, but preferably one or more adjacent printing elements are also considered in order to estimate the energy supplied thereto. If the print element in question is termed a first print element, then the energy supplied to at least one second printing element adjacent to the first printing element in at least one supply step preceding the current supply step is preferably considered in the determination step.

Here the energy feed that has occurred or is to occur to the printing element and/or its neighbors in the last supply step before the current supply step is considered. The previous energy supply to the printing element and/or its neighbors in the penultimate supply step before the current feed step is also preferably taken into account. Particularly good estimates of the optimal energy quantity to be supplied can be achieved with this embodiment.

The print parameters can be arbitrary parameters that can be consulted to determine the correct activation values for the printing elements. For example, they can directly concern voltages and/or currents and/or pulse lengths etc. that could be directly used for control of the printing elements. The print parameter set is advantageously an energy parameter set, since the corresponding control parameters can be quickly calculated from this independently of the design of the print head.

In a preferred variant of the embodiment of the inventive method with consideration of the previous printing history, the print parameter set contains a number of energy supply values for different energy supply constellations in at least one preceding supply step. The current energy value to be supplied to the printing element in question can then be calculated from this in a simple manner, dependent on the detected or registered previous printing history.

The energy quantity preferably is determined in the determination step using at least the first print parameter set, by a reduction from a predetermined maximum energy quantity to be supplied being subtracted from the energy supply that occurred in at least one preceding supply step to at least the printing element. The required optimal energy quantity thus can be determined particularly simply and quickly.

It is particularly advantageous to use print parameters that vary dependent on the print image to be generated in the control of the printing elements. For example, print parameters can be used in the generation of one-dimensional or two-dimensional barcodes that are different than those used in the generation of text or graphics. It has been shown that particularly good print results can be achieved with this use of print parameters matched to the print image to be generated.

The print parameter set therefore preferably contains at least two different partial parameter sets respectively for different print image types to be generated. Depending on the print image type of the current print image to be generated, the respectively associated partial parameter set is then used in the control.

The invention encompasses the independent idea of the control of the printing elements described above using print parameters that vary dependent on the print image to be generated. This is independent of the storage of the print parameters in the memory associated with the ink carrier device.

The present invention furthermore concerns a method for operation of a printer with a print head with a number of printing elements, operating according to the thermotransfer principle. The print head is connected with a processing unit of the printer for control. Furthermore, an ink carrier device is provided that is connected with the processing unit of the printer in a connection step. The print head is thereby controlled by the processing unit with the inventive method for control described above. In accordance with the invention the read step is triggered by at least one predetermined event.

Such a predetermined event can be an arbitrary temporal or non-temporal event. For example, the event can be reaching specific, predetermined points in time. The event can likewise be the occurrence of a specific, predetermined operating state of the printer. The read step can ensue, for example, ensue at every n-th activation (with n=1, 2, 3 etc.) of the printer. The event can naturally also be a specific input of a user or from a remote data center.

The event preferably is the connection of the memory with the processing unit. In other words, the read step is triggered by the connection of the memory with the processing unit. This ensures that the correct printing parameters are read and provided for control upon each new or repeated use of an ink carrier device.

The print parameter set or individual print parameters can be read out again from the memory upon each activation. The print parameter set preferably is read out from the memory (as a first memory) in the read step and stored in a second memory connected with the processing unit, the second memory is then accessed for activation in the further method workflow. Faster processing times thus can be achieved since such a second memory in the printer (for example a faster working memory that is frequently present anyway in the printer) can be addressed faster. The expenditure for the first memory (in particular its fast address capability) can then be kept low.

The present invention furthermore concerns a printer with a printing device operating according to the thermotransfer principle, the printing device having a print head with a number of printing elements and a processing unit connected with the print head for control of the print head. Furthermore, the printer has an ink carrier device removably associated with the print head. The processing unit determines the energy quantity to be supplied to a printing element and to trigger supply of the energy quantity to the printing element in order to transfer ink from the ink carrier device to a substrate associated with the ink carrier device. According to the invention, a memory associated with the ink carrier device is provided in which is stored a print parameter set characteristic of the ink carrier device. Furthermore, the processing unit is fashioned for reading the print parameter set as well as for determination of the energy quantity using at least the print parameter set.

This printer is suited for implementation of the inventive method. With it the advantages and variants of the inventive method described above also can be achieved.

The memory is preferably connected with the ink carrier device as described above. Furthermore, the processing unit is preferably fashioned for determination (described above) by interpolation of intermediate values of the first print parameter value for values of the first state parameter lying between the discrete values of the state parameter.

In order to be able to account for the previous printing history as described above, the processing unit preferably accounts for the energy supply to at least the first printing element that has occurred preceding the current supply events. The processing unit is furthermore preferably fashioned to account for the energy supply that has previously occurred to at least one further printing element adjacent to the printing element in question. The processing unit is preferably fashioned to account for the last-occurring energy supply and/or to account for the penultimately occurring energy supply.

Furthermore, the processing unit is preferably fashioned to read the memory when triggered by at least one predetermined event, in particular when triggered by the connection of the memory with the processing unit. It is furthermore preferably fashioned for storage of the print parameter set in a second memory connected with the processing unit.

The inventive printer in principle can be used for any application. It can be used particularly advantageously in connection with a franking machine. This in particular applies when, as described above, different print image-dependent print parameters are used. In a franking machine this can be implemented by using different print parameters in the generation of text or graphics than in the generation of one-dimensional or two-dimensional barcodes. The inventive printer is preferably fashioned as a printer unit of a franking machine.

The present invention furthermore concerns a franking machine with an inventive printer. The present invention furthermore concerns an ink carrier device (in particular ink ribbon cassette) for an inventive printer that exhibits the features of the ink carrier device described above in connection with the inventive printer. Finally, it furthermore concerns a printing device for an inventive printer which exhibits the features of the printing device described above in connection with the inventive printer.

DESCRIPTION OF THE PREFERRED EMBODIMENTS

Figure 1:
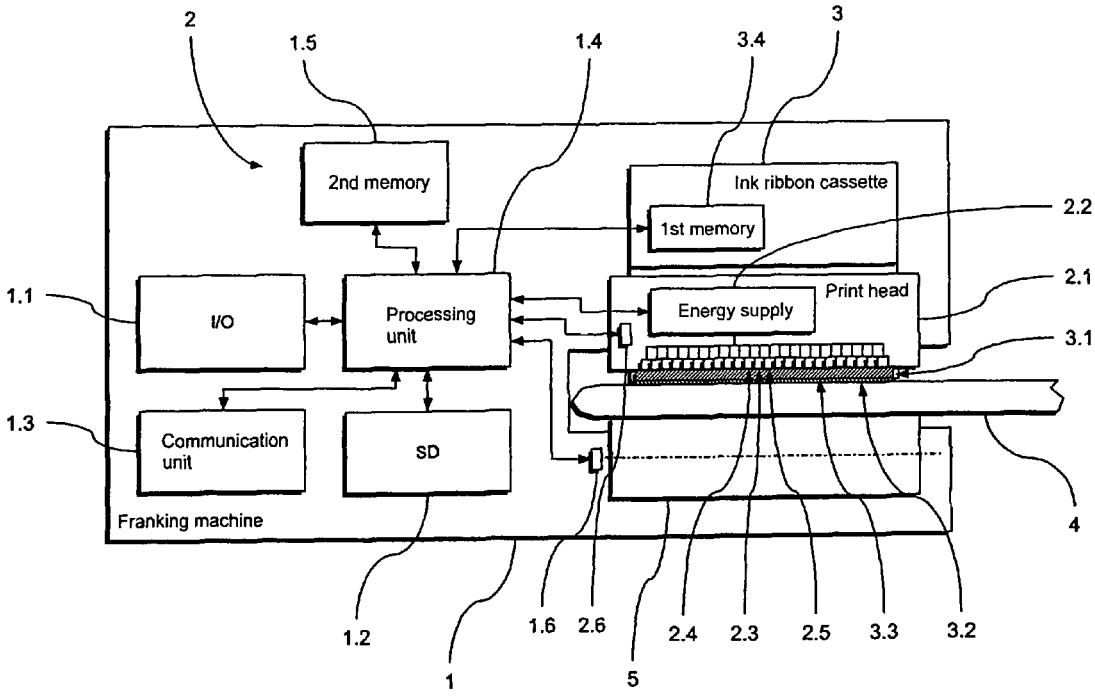
FIG. 1 schematically illustrates a preferred embodiment of the inventive printer with which a preferred embodiment of the inventive method for activation of a print head can be implemented.

FIG. 1 schematically shows a franking machine 1 with a preferred embodiment of the inventive printer 2. The printer 2 is operated according to a preferred embodiment of the inventive method for operation of a printer. A preferred embodiment of the inventive method for activation of a print head is also hereby used.

The printer 2 forms the printer unit of the franking machine 1. In addition to the printer 2, the franking machine 1 has further components such as, for example, an input/output unit 1.1, a security module 1.2 in the form of what is known as a PSD or SAD (what is known as an SD for short) and a communication unit 1.3.

A user can enter information into the franking machine 1 and information can be output to the user via the input/output unit 1.1, for example a module with keyboard and display. The security module 1.2 provides security functionalities for physical and logical securing of the security-relevant data of the franking machine 1. The franking machine 1 can be connected, for example, with remote devices (for example a remote data center) over a computer network via the communication unit 1.3.

Among other things, the printer 2 has a processing unit 1.4, a print head 2.1 and an ink carrier device in the form of an ink ribbon cassette 3. The processing unit 1.3 is a central processing unit of the franking machine 1 which, in addition to other functions, assumes the control of the print head 2.1 for printing.

The print head 2.1 has an energy supply device 2.2 that supplies a series of n printing elements 2.3, 2.4, 2.5 with energy. The energy supply device 2.2 is controlled by the processing unit 1.4 for this purpose.

The ink ribbon cassette 3 is associated with the print head 2.1 such that its ink ribbon 3.1 contacts the printing elements 2.3, 2.4, 2.5 of the print head 2.1 at its back side. For printing, the printing elements 2.3, 2.4, 2.5, controlled by the processing unit 1.4, are respectively supplied by the energy supply device 2.2 with a precisely-quantified energy quantity in order to locally melt ink particles of the ink layer 3.2 that is located on the ink carrier 3.3 of the ink ribbon 3.1. These ink particles are then transferred onto a substrate 4, for example a letter to be franked. For this purpose, the letter 4 is fed past the print head 2.1 and is pressed by pressure rollers against the ink ribbon 3.1 situated between them.

The ink ribbon cassette 3 has a first memory 3.4 that is automatically connected with the processing unit 1.4 by corresponding contact elements upon association of the ink ribbon cassette 3 with the printer 2, in other words upon insertion of the ink ribbon cassette 3 into the franking machine 1. The print parameters associated with the ink ribbon cassette 3 are stored in the first memory 3.4 as a first print parameter set. These print parameters are (as explained in the following) used for control of the print head 2.1.

Figure 2:
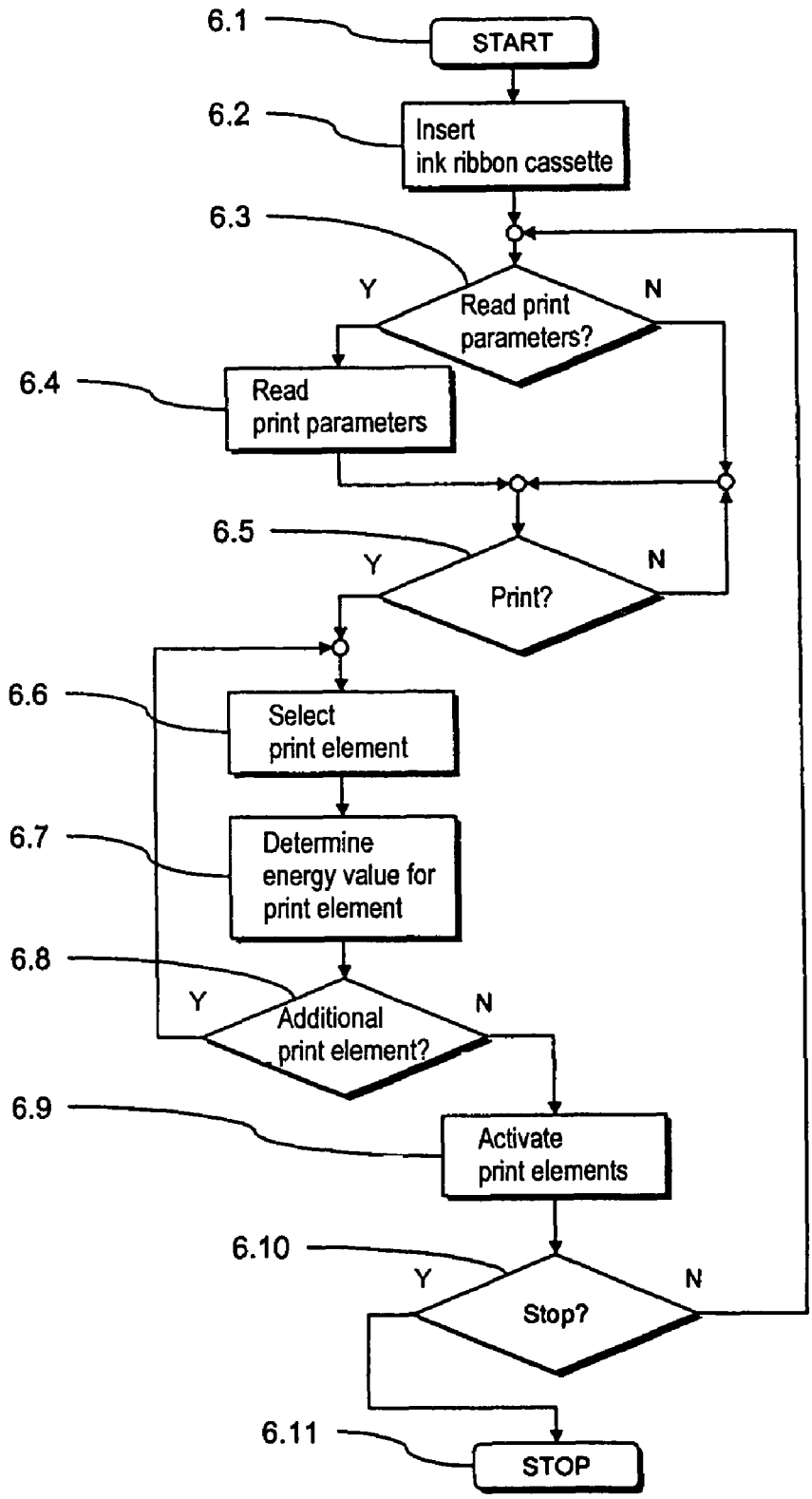
FIG. 2 is a flow chart of a preferred embodiment of the inventive method for operation of a printer using a preferred embodiment of the inventive method for activation of a print head, which can be implemented with the printer of FIG. 1.

In the following, a preferred embodiment of the inventive method for operation of a printer using a preferred embodiment of the inventive method for control of a print head, which method is implemented with the printer 2 of FIG. 1, is described with reference to FIGS. 1 and 2.

The method workflow is initially started in a step 6.1. In a connection step 6.2, the ink ribbon cassette 3 is inserted into the franking machine 1 such that it is correctly associated with the print head 2.1. As described above, the first memory 3.4 is automatically connected with the processing unit 1.4 by corresponding contact elements.

In a step 6.3, the processing unit 1.4 checks whether a reading of the print parameters from the first memory should ensue. This is the case when the described insertion of an ink ribbon cassette 3 has been detected as a first event. It is likewise established that the reading should ensue after each activation of the franking machine 1. The activation of the franking machine 1 thus likewise represents an event triggering the reading of the print parameters. It is hereby understood that, in other variants of the invention, other temporal or non-temporal events can also be defined which trigger the reading of the print parameters as this has already been described above.

If the reading of the print parameters should ensue, the processing unit 1.4 automatically reads the first print parameter set from the first memory 3.4 in a read step 6.4. The processing unit 1.4 thereby stores the parameter set in a second memory 1.5 (in the form of a volatile working memory of the franking machine 1) connected with the processing unit 1.4. It is understood that, in other variants of the invention, the second memory 1.5 can be a non-volatile memory. Moreover, it can then suffice to read the print parameters from the first memory 3.4 only at every detected insertion of an ink ribbon cassette.

In a step 6.5, it is checked whether a printing process should be implemented, for example whether a letter 4 should be franked. If this is the case, in a step 6.6 the first printing element of the print head 2.1 to be activated is initially selected according to the print image to be generated.

In a determination step 6.7, the processing unit 1.4 then estimates, with access to the first print parameter set stored in the first memory 1.5, the optimal energy quantity with which the selected printing element must be supplied in order to generate a qualitatively high-grade franking imprint on the letter 4. The estimation of the energy quantity is explained in further detail in the following.

In a step 6.8, the processing unit then checks whether a printing element of the print head 2.1 is to be activated. If this is the case, the process jumps back to step 6.6, in which the next printing element of the print head 2.1 to be activated is then selected.

All optimal energy quantities for the printing elements are determined beforehand in this manner for the print image to be created. In other words, the activation sequences for the print head 2.1 are determined beforehand.

In a step 6.9 comprising all supply steps for the print image to be generated, the processing unit 1.4 then controls the energy supply device 2.2 such that the corresponding first energy quantity is respectively supplied to the individual printing elements. The determination of the energy quantities beforehand for the entire print image thereby has the advantage that a faster printing process can be achieved.

The printing ensues in columns. All printing elements of the print head 2.1 to be activated according to the print image to be generated are thereby activated in an activation sequence for generation of a print column. In a further activation sequence, all printing elements of the print head 2.1 to be activated according to the print image to be generated are then activated in turn for generation of the next print column.

If no further printing element is to be activated, for example because all columns of the print image have been printed or a termination has occurred, in a step 6.10 it is finally checked whether the method workflow should be ended. If this is the case, the method workflow ends in a step 6.1. Otherwise, the method jumps back to the step 6.3.

In the following, in an example of a first printing element 2.3 it is explained in detail how the estimation of the energy quantity E ensues via the processing unit 1.4 in the determination step using the print parameter set.

The energy quantity $E_{p,a}$ to be supplied to the printing element 2.3 to be activated is a function of the temperature of the first printing element 2.3 necessary for the optimal melting of the ink particles and is a function of the current temperature of the printing element 2.3. The closer the current temperature of the printing element 2.3 lies to the required optimal temperature of the first printing element 2.3, the less current energy quantity $E_{p,a}$ is to be supplied.

The current temperature of the printing element 2.3 is a function of the current temperature in its environment, which in the present case is detected by a temperature sensor 2.6 in the print head 2.1. Furthermore, it is a function of the relevant previous printing history of the printing element 2.3 and of both of its adjacent printing elements 2.4 and 2.5. If the printing element 2.3, or one of the two adjacent printing elements 2.4 and 2.5, was supplied with energy in a preceding feed step, a specific residual energy surplus from this is still present in the printing element 2.3, which specific residual energy surplus expresses itself as an increased temperature.

Since this residual energy surplus is comparably rapidly dissipated by heat transfer to the environment, in the present example it is sufficient only to account for the activation of the printing element 2.3 and its two adjacent printing elements 2.4 and 2.5 in the immediately preceding last activation sequence (i.e. the last printed print column) as well as the activation of the printing element 2.3 itself in the activation sequence before last (i.e. the penultimate printed print column) in order to achieve a sufficiently precise estimation of the required energy quantity $E_{p,a}$.

In other variants of the invention, however, consideration of the previous printing history can be provided that goes even further back in time, or less far back. This can in particular depend on the design of the print head, in particular the heat transfer rates predominating there.

In the determination step 6.7, the processing unit 1.4 estimates the current energy quantity $E_{p,a}$ to be supplied under consideration of the previous printing history of the printing element 2.3 and its two adjacent printing elements 2.4 and 2.5 according to the following energy quantity:

$$E_{p,a}=E_{max}-(s_{p,v}\cdot\Delta E_{p,v})-(s_{pnl,v}\cdot\Delta E_{pn,v})-(s_{pnr,v}\cdot\Delta E_{pn,v})-(s_{p,vv}\cdot\Delta E_{p,vv}) \quad (1)$$

wherein: $E_{max}$ energy that must be supplied to a printing element when no energy was supplied to it during the last and penultimate activation sequence and no energy was supplied to its immediate neighbors during the last activation sequence;

$\Delta E_{p,v}$: energy reduction for an activation of the printing element in the last activation sequence;

$\Delta E_{p,vv}$: energy reduction for an activation of the printing element in the penultimate activation sequence;

$\Delta E_{pn,v}$: energy reduction for an activation of an immediately adjacent printing element in the last activation sequence;

$s_{p,v}$: logical value of the activation of the printing element in the last activation sequence;

$s_{p,vv}$: logical value of the activation of the printing element in the penultimate activation sequence;

$s_{pnl,v}$: logical value of the activation of the printing element immediately adjacent to the left in the last activation sequence;

$s_{pnr,v}$: logical value of the activation of the printing element immediately adjacent to the right in the last activation sequence.

The logical values have the value "1" when the appertaining activation actually occurs or the value "0" when the appertaining activation has not occurred. The logical values are protocolled by the processing unit 1.4 in the second memory 1.5. At every conclusion of a printing event, they are set to the value "0" by the processing unit 1.4 when it is assumed by this that the time to the next printing event is so long that the residual energy surplus would dissipate to the environment via heat transfer. If this is not the case, this reset can also correspondingly ensue with a time delay in order to also operate with the optimal energy quantities given a fast subsequent further print image.

In each determination step 6.7, the appertaining logic values for the printing elements to be considered are read out from the second memory 1.5. In the present case, 16 possible different previous history constellations with different values for the current energy quantity $E_{p,a}$ to be supplied this result.

The energy reductions are thereby calculated according to the following equations:

$$\Delta E_{p,v} = E_{max} - E_{p,v}, \tag{2}$$

$$\Delta E_{p,vv} = E_{pn,v} - E_{min}, \tag{3}$$

$$\Delta E_{pn,v} = \frac{E_{p,v} - E_{pn,v}}{2}, \tag{4}$$

wherein: $E_{max}$: energy that must be supplied to a printing element when no energy was supplied to it during the last and penultimate activation sequence and no energy was supplied to its immediate neighbors during the last activation sequence;

$E_{p,v}$: energy that must be supplied to a printing element when an activation of the printing element occurred in the last activation sequence;

$E_{pn,v}$: energy that must be supplied to a printing element when an activation of the printing element and both of its neighbors occurred in the last activation sequence;

$E_{min}$: energy that must be supplied to a printing element when an activation of the printing element and both of its neighbors occurred in the last activation sequence and an activation of the printing element occurred in the penultimate activation sequence.

The energy values $E_{max}$, $E_{p,v}$, $E_{pn,v}$ and $E_{min}$ thus represent energy supply values for different energy feed constellations in preceding energy feed steps, from which energy feed values the energy reductions for the respective previous printing histories can be determined.

The energy values $E_{max}$, $E_{p,v}$, $E_{pn,v}$ and $E_{min}$ represent print parameter values in the form of energy parameter values that are stored in the first print parameter set. In the present example, the print parameter set comprises a first partial parameter set in which are stored discrete evaluations $E_{max}$, $E_{p,v}$, $E_{pn,v}$ and $E_{min}$ for two different feed speeds of the letter 4 and a series of different temperatures of the print head 2.1. The subsequent table 1 shows an example for this first partial parameter set.

The energy values $E_{max}$, $E_{p,v}$, $E_{pn,v}$ and $E_{min}$ of the first partial parameter set are thereby matched to the ink ribbon cassette 3 or the ink ribbon 3.1, in particular the ink particles of the ink layer 3.2. They are furthermore matched to a specific type of print image to be generated, namely the generation of a two-dimensional barcode.

TABLE 1

| First Partial Parameter Set | | | | | | | |
|---|---|---|---|---|---|---|---|
| | | 10° C. | 20° C. | 30° C. | 40° C. | 50° C. | 55° C. |
| $E_{max}$ | 133 mm/s | 294 | 277 | 247 | 202 | 159 | 110 |
| [μJ] | 150 mm/s | 293 | 280 | 248 | 199 | 159 | 110 |
| $E_{p,v}$ | 133 mm/s | 179 | 168 | 160 | 136 | 109 | 80 |
| [μJ] | 150 mm/s | 183 | 168 | 156 | 136 | 109 | 80 |
| $E_{pn,v}$ | 133 mm/s | 135 | 120 | 104 | 104 | 81 | 60 |
| [μJ] | 150 mm/s | 125 | 108 | 104 | 97 | 79 | 60 |
| $E_{min}$ | 133 mm/s | 91 | 76 | 71 | 85 | 66 | 50 |
| [μJ] | 150 mm/s | 87 | 68 | 67 | 75 | 62 | 50 |

The first print parameter set comprises two more partial parameter sets whose energy values $E_{max}$, $E_{p,v}$, $E_{pn,v}$ and $E_{min}$ are likewise matched to the ink ribbon cassette 3 or, respectively, the ink ribbon 3.1. These are a second partial parameter set that is furthermore matched to the generation of a one-dimensional barcode and a third partial parameter set that is furthermore tuned to the generation of text and free graphics.

The temperature of the print head 2.1 and the feed speed of the letter 4 thereby respectively represent a state parameter predominating in the region of the print head, which state parameters are incorporated into the determination of the current energy quantity $E_{p,a}$ to be supplied. The temperature of the print head 2.1 is detected with the temperature sensor 2.6 and relayed to the processing unit 1.5. The feed speed of the letter 4 is detected via the sensor 1.6 and likewise relayed to the processing unit 1.4.

It is understood that, in other variants of the invention, other state parameters that have a corresponding influence on the print result can be additionally or alternatively considered.

In the determination of the current energy quantity $E_{p,a}$, the processing unit 1.4 initially selects the corresponding partial parameter set corresponding to the type of the current print image to be generated. It then extracts the corresponding energy values $E_{max}$, $E_{p,v}$, $E_{pn,v}$ and $E_{min}$ from the selected partial parameter set using the values supplied by the temperature sensor 2.6 and the sensor 1.6.

For the case that the values of the temperature sensor 2.6 or, respectively, of the sensor 1.6 lie between the values of the selected partial parameter set, the processing unit 1.4 determines via linear interpolation an intermediate value for the respective energy value $E_{max}$, $E_{p,v}$, $E_{pn,v}$ and $E_{min}$.

It is understood that, in other variants of the invention, a different type of the determination of such intermediate values can also be provided. A correspondingly fine sub-division of the stored energy values $E_{max}$, $E_{p,v}$, $E_{pn,v}$ and $E_{min}$ can likewise also be provided, such that the determination of such intermediate values is unnecessary for an estimation with sufficient precision.

If the correct energy values $E_{max}$, $E_{p,v}$, $E_{pn,v}$ and $E_{min}$ have been determined in this manner, the processing unit still reads the logic values $s_{p,v}$, $s_{p,vv}$, $s_{pnl,v}$ and $s_{pnl}$, belonging to the printing element 2.3 from the second memory 1.5 and then calculates the current energy quantity $E_{p,a}$ to be supplied to the printing element 2.3 via the equations (1) through (4). This is then used for control of the printing element 2.3 as described above.

The described usage of energy parameter sets has the advantage that the processing unit 1.4 can quickly calculate the corresponding activation parameters from these, independent of the design of the print head 2.1, using corresponding characteristics of the print head 2.1 that can likewise be stored in the second memory. Alternatively, the energy supply device 2.2 can also be fashioned for this conversion, such that the processing unit 1.4 only has to transfer to the energy supply device 2.2 the current energy quantity $E_{p,a}$ to be supplied.

Figure 3:
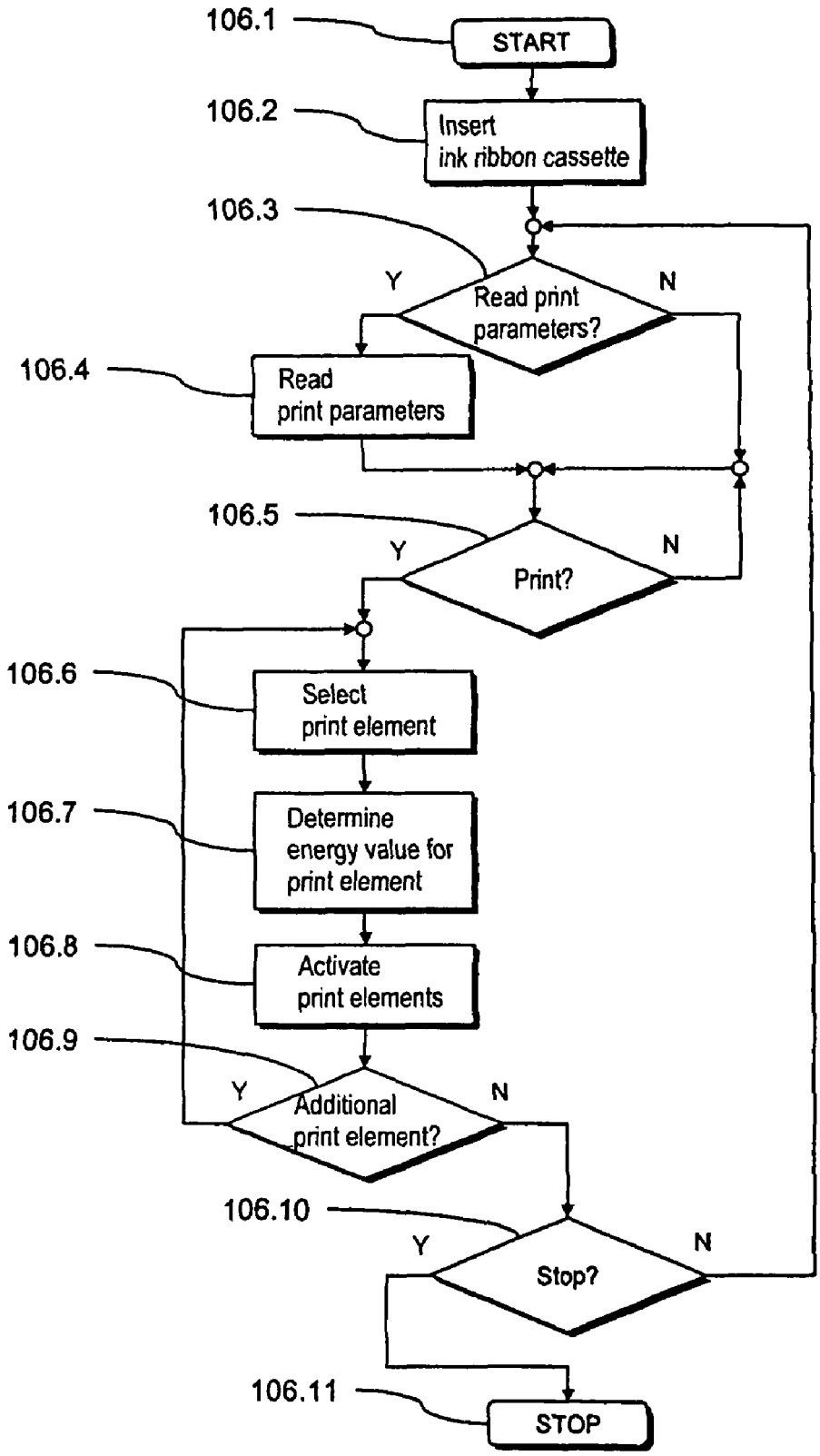
FIG. 3 is a flow chart of a further preferred embodiment of the inventive method for operation of a printer using a preferred embodiment of the inventive method for activation of a print head, which can be implemented with the printer of FIG. 1.

In the following, a further preferred embodiment of the inventive method for operating of a printer using a preferred embodiment of the inventive method for activation of a print head, which can be implemented with the printer 2 of FIG. 1, is described with reference to FIGS. 1 and 3.

The method workflow is initially started in a step 106.1. In a connection step 106.2, the ink ribbon cassette 3 is inserted into the franking machine 1 such that it is correctly associated with the print head 2.1. As described above, the first memory 3.4 is hereby automatically connected with the processing unit 1.4 via corresponding contact elements.

In a step 106.3, the processing unit 1.4 checks whether a reading of the print parameters from the first memory should ensue. This is the case when the described insertion of an ink ribbon cassette 3 has been detected as a first event. It is likewise established that the reading should ensue after each activation of the franking machine 1. The activation of the franking machine 1 thus likewise represents an event triggering the reading of the print parameters. It is understood that, in other variants of the invention, other temporal or non-temporal events can be defined that trigger the reading of the print parameters, as described above.

If the reading of the print parameters should ensue, in a read step 106.4 the processing unit 1.4 automatically reads the first print parameter set from the first memory 3.4. The processing unit stores the parameter set in a second memory 1.5 (in the form of a volatile working of the franking machine 1) connected with the processing unit 1.4. It is understood that, in other variants of the invention, the second memory 1.5 can be a non-volatile memory. Moreover, it can then also suffice to read the print parameters from the first memory 3.4 only at each detected insertion of an ink ribbon cassette.

In a step 106.5, it is checked whether a print process should be implemented, for example thus whether a letter 4 should be franked. If this is the case, the first printing element of the print head 2.1 to be activated according to the print image to be generated is initially selected in a step 106.6.

In a determination step 106.7, the processing unit 1.4 then estimates the optimal first energy quantity under access to the first print parameter set stored in the second memory, with which first energy quantity the selected printing element must be supplied in order to generate a qualitatively high-grade franking imprint on the letter 4. The estimation of the energy quantity ensues was explained above in detail in connection with the exemplary embodiment from FIG. 2.

In a supply step 106.8, the processing unit 1.4 then controls the energy supply device 2.2 such that a corresponding first energy quantity is supplied to the selected printing element.

In other words, in the present example a determination of the first energy quantity ensues immediately before the activation of each printing element. This has the advantage that the temperature of the print head 2.1, which temperature is to be taken into account in the determination of the first energy quantity, enters into the determination with higher precision. Furthermore, the actual previous printing histories are considered, and not only the anticipated previous printing histories, meaning that the malfunction or omission of one or more activations can be detected and considered.

In a step 106.9, the processing unit then checks whether a further printing element of the print head 2.1 is to be activated. If this is the case, the process jumps back to step 106.6, in which the next printing element of the print head 2.1 to be activated is selected.

The printing ensues in columns. All printing elements of the print head 2.1 to be activated according to the print image to be generated are thereby activated in an activation sequence for generation of a print column. To generate the next print column, all printing elements of the print head 2.1 to be activated according to the print image to be generated are then activated in turn in a further activation sequence.

If no further printing element is to be activated, for example because all columns of the print image have been printed or a termination has occurred, in a step 106.10 it is finally checked whether the method workflow should be ended. If this is the case, the method workflow ends in a step 106.11. Otherwise, the method jumps back to the step 106.3.

The present invention was described in the preceding using two examples in which the energy quantities were either determined beforehand for the entire print image (FIG. 2) or were determined separately, immediately before the activation, for each individual activation of a printing element. It is understood that, in other variants of the invention, a procedure residing between these extreme variants can also be used. The determination of the energy quantities thus can ensue, for example, beforehand for the respective print column. The determination of the energy quantities can already ensue while the activation sequence for the preceding print column is still running, such that no noteworthy time loss is associated with this determination.

The present invention was described in the preceding using examples making use of energy parameter sets, but it is understood that, in other variants of the invention, arbitrary parameters that are relevant for determination of the correct activation values for the printing elements can be used as the print parameters. For example, these can be voltages and/or currents and/or pulse lengths that could be employed in a determination step immediately before activation of the printing elements.

Although the present invention was described in the preceding using examples with a franking machine, it is understood that the invention can also be used for many other applications.

Although modifications and changes may be suggested by those skilled in the art, it is the intention of the inventor to embody within the patent warranted hereon all changes and modifications as reasonably and properly come within the scope of his contribution to the art.

I claim as my invention:

1. A method for controlling individual activation of respective printing elements of a thermo transfer print head to melt ink carried on an ink carrier of an ink carrier device to transfer said ink onto a print medium, said method comprising the steps of:

electronically reading out a print parameter set from a memory associated with said ink carrier device, containing at least one parameter that is specifically characteristic of said ink carrier device;

for a printing element of said print head, automatically electronically determining a control quantity specifically relevant to melting, by said printing element, said ink carried by said ink carrier of said ink carrier device from said print parameter set read out from said memory, dependent on a preceding activation of said printing element and a preceding activation of a further printing element neighboring said printing element in said print head; and automatically electronically activating said printing element using said control quantity to cause said printing element to melt said ink to transfer said ink onto said print medium.

2. A method as claimed in claim 1 wherein said control quantity is an energy quantity, and wherein the step of activating said printing element comprises activating said printing element by supplying said energy quantity to said printing element.

3. A method as claimed in claim 1 wherein the step of reading out said print parameter set comprises reading out a print parameter set from a memory physically carried by said ink carrier device.

4. A method as claimed in claim 1 wherein the step of reading out a print parameter set comprises reading out a print parameter set from said memory comprising at least one print parameter that is a function of at least one state parameter that predominates in an environment of said print head.

5. A method as claimed in claim 4 comprising selecting said state parameter from the group consisting of ambient temperature in said environment of said print head, a relative speed of said print medium with respect to said printing element, and a relative speed of said print medium with respect to said ink carrier device.

6. A method as claimed in claim 1 wherein the step of determining a control quantity comprises determining said control quantity for a current activation of said printing element dependent on a control quantity used in a preceding activation of said printing element.

7. A method as claimed in claim 6 comprising determining said control quantity for said current activation of said printing element dependent on said control quantity used in an immediately preceding activation of said printing element.

8. A method as claimed in claim 6 comprising determining said control quantity for said current activation of said printing element dependent on said control quantity used in an immediately preceding activation of said printing element and said control quantity used in a penultimate activation of said printing element.

9. A printer comprising:

a thermo transfer print head having a plurality of individually actuatable printing elements;

an ink carrier device comprising an ink carrier carrying ink thereon, said ink carrier device being removably disposed at a position to interact with said printing elements of said print head, said printing elements of said print head, when individually activated, melting said ink carried on said ink carrier to transfer said ink onto a print medium;

a memory associated with said ink carrier device having a print parameter set stored therein containing at least one parameter that is specifically characteristic of said ink carrier device;

a processing unit connected to said print head and being placed in communication with said memory when said ink carrier device is in said position, said processing unit reading out said print parameter set from said memory and determining, for a printing element of said print head, a control quantity specifically relevant to melting, by said printing element of said print head, said ink carried by said ink carrier of said ink carrier device, dependent on a preceding activation of said printing element and a preceding activation of a further printing element neighboring said printing element in said print head; and said processing unit controlling activation of said print element of said print head using said control quantity to cause said print element of said print head to melt said ink to transfer said ink to said print medium.

10. A printer as claimed in claim 9 wherein said control quantity is an energy quantity, and wherein said processing unit activates said printing element by supplying said energy quantity to said printing element.

11. A printer as claimed in claim 9 wherein memory is physically carried by said ink carrier device.

12. A printer as claimed in claim 9 wherein said print parameter set stored in said memory comprises at least one print parameter that is a function of at least one state parameter that predominates in an environment of said print head.

13. A printer as claimed in claim 12 wherein said state parameter is selected from the group consisting of ambient temperature in said environment of said print head, a relative speed of said print medium with respect to said printing element, and a relative speed of said print medium with respect to said ink carrier device.

14. A printer as claimed in claim 9 wherein said processing unit determines said control quantity by determining said control quantity for a current activation of said printing element dependent on a control quantity used in a preceding activation of said printing element.

15. A printer as claimed in claim 14 wherein said processing unit determines said control quantity for said current activation of said printing element dependent on said control quantity used in an immediately preceding activation of said printing element.

16. A printer as claimed in claim 14 wherein said processing unit determines said control quantity for said current activation of said printing element dependent on said control quantity used in an immediately preceding activation of said printing element and said control quantity used in a penultimate activation of said printing element.

17. A printer as claimed in claim 9 wherein said processing unit detects a predetermined event, and reads out said print parameter from said memory upon detection of said predetermined event.

18. A printer as claimed in claim 17 wherein said memory is a first memory, and comprising a second memory connected to said processing unit, and wherein said processing unit reads out said print parameter set from said first memory and causes said print parameter set to be stored in said second memory.

19. A method for controlling individual activation of respective printing elements of a thermo transfer print head to melt ink carried on an ink carrier of an ink carrier device to transfer said ink onto a print medium, said method comprising the steps of:

electronically reading out a print parameter set from a memory associated with said ink carrier device, containing a partial parameter set that is specifically characteristic of said ink carrier device, said partial parameter set, including a plurality of print parameter values respectively formed as a function of a plurality of different discrete values of a state parameter that predominates in an environment of said print head;

for a printing element of said print head, automatically electronically determining a control quantity specifically relevant to melting, by said printing element, said ink carried by said ink carrier of said ink carrier device from said partial print parameter set read out from said memory, by electronically interpolating an intermediate value of said print parameter value for respective values of said state parameter between said discrete values; and automatically electronically activating said printing element using said control quantity to cause said printing element to melt said ink to transfer said ink onto said print medium.

20. A method for controlling individual activation of respective printing elements of a thermo transfer print head to melt ink carried on an ink carrier of an ink carrier device to transfer said ink onto a print medium, said method comprising the steps of:

electronically reading out an energy parameter set from a memory associated with said ink carrier device, said energy parameter set comprising a plurality of energy supply values to respective printing elements of said print head for different energy supply constellations in a preceding activation of said printing element;

for a printing element of said print head, automatically electronically determining a control quantity specifically relevant to melting, by said printing element, said ink carried by said ink carrier of said ink carrier device from said energy parameter set read out from said memory; and automatically electronically activating said printing element using said control quantity to cause said printing element to melt said ink to transfer said ink onto said print medium.

21. A method for controlling individual activation of respective printing elements of a thermo transfer print head to melt ink carried on an ink carrier of an ink carrier device to transfer said ink onto a print medium, said method comprising the steps of:

electronically reading out a print parameter set from a memory associated with said ink carrier device, said print parameter set comprising an energy quantity supplied to said printing element in a preceding activation of said printing element;

for a printing element of said print head, automatically electronically determining an energy quantity specifically relevant to melting, by said printing element, said ink carried by said ink carrier of said ink carrier device from said print parameter set read out from said memory by, for a current activation of said printing element, subtracting, from a predetermined maximum energy quantity, a reduction in energy supply to said printing element related to at least one activation of said printing element preceding said current activation; and automatically electronically activating said printing element using said energy quantity to cause said printing element to melt said ink to transfer said ink onto said print medium.

22. A method for controlling individual activation of respective printing elements of a thermo transfer print head to melt ink carried on an ink carrier of an ink carrier device to transfer said ink onto a print medium, said method comprising the steps of:

electronically reading out a print parameter set from a memory associated with said ink carrier device, said print parameter set comprising a plurality of different partial parameter sets respectively for different print image types;

for a printing element of said print head, automatically electronically determining a control quantity specifically relevant to melting, by said printing element, said ink carried by said ink carrier of said ink carrier device from said print parameter set read out from said memory, using the respective partial parameter set for a print image type to be printed in a current activation of said print element; and automatically electronically activating said printing element using said control quantity to cause said printing element to melt said ink to transfer said ink onto said print medium.

23. A printer comprising:

a thermo transfer print head having a plurality of individually actuatable printing elements;

an ink carrier device comprising an ink carrier carrying ink thereon, said ink carrier device being removably disposed at a position to interact with said printing elements of said print head, said printing elements of said print head, when individually activated, melting said ink carried on said ink carrier to transfer said ink onto a print medium;

a memory associated with said ink carrier device having a print parameter set stored therein containing a partial parameter set that is specifically characteristic of said ink carrier device, said partial parameter set, including a plurality of print parameter values respectively formed as a function of a plurality of different discrete values of a state parameter that predominates in an environment of said print head;

a processing unit connected to said print head and being placed in communication with said memory when said ink carrier device is in said position, said processing unit reading out said print parameter set from said memory and determining, for a printing element of said print head, a control quantity specifically relevant to melting, by said printing element of said print head, said ink carried by said ink carrier of said ink carrier device, by electronically interpolating an intermediate value of said print parameter value for respective values of said state parameter between said discrete values; and said processing unit controlling activation of said print element of said print head using said control quantity to cause said print element of said print head to melt said ink to transfer said ink to said print medium.

24. A printer comprising:

a thermo transfer print head having a plurality of individually actuatable printing elements;

an ink carrier device comprising an ink carrier carrying ink thereon, said ink carrier device being removably disposed at a position to interact with said printing elements of said print head, said printing elements of said print head, when individually activated, melting said ink carried on said ink carrier to transfer said ink onto a print medium;

a memory associated with said ink carrier device having an energy parameter set stored therein, said energy set comprising a plurality of energy supply values to respective printing elements of said print head for different energy supply constellations in a preceding activation of said printing element;

a processing unit connected to said print head and being placed in communication with said memory when said ink carrier device is in said position, said processing unit reading out said energy parameter set from said memory and determining, for a printing element of said print head, a control quantity specifically relevant to melting, by said printing element of said print head, said ink carried by said ink carrier of said ink carrier device; and said processing unit controlling activation of said print element of said print head using said control quantity to cause said print element of said print head to melt said ink to transfer said ink to said print medium.

25. A printer comprising:

a thermo transfer print head having a plurality of individually actuatable printing elements;

an ink carrier device comprising an ink carrier carrying ink thereon, said ink carrier device being removably disposed at a position to interact with said printing elements of said print head, said printing elements of said print head, when individually activated, melting said ink carried on said ink carrier to transfer said ink onto a print medium;

a memory associated with said ink carrier device having a print parameter set stored therein, said print parameter set comprising an energy quantity supplied to said printing element in a preceding activation of said printing element;

a processing unit connected to said print head and being placed in communication with said memory when said ink carrier device is in said position, said processing unit reading out said print parameter set from said memory and determining, for a printing element of said print head, an energy quantity specifically relevant to melting, by said printing element of said print head, said ink carried by said ink carrier of said ink carrier device by, for a current activation of said printing element, subtracting, from a predetermined maximum energy quantity, a reduction in energy supply to said printing element related to at least one activation of said printing element preceding said current activation; and said processing unit controlling activation of said print element of said print head using said energy quantity to cause said print element of said print head to melt said ink to transfer said ink to said print medium.

26. A printer comprising:

a thermo transfer print head having a plurality of individually actuatable printing elements;

an ink carrier device comprising an ink carrier carrying ink thereon, said ink carrier device being removably disposed at a position to interact with said printing elements of said print head, said printing elements of said print head, when individually activated, melting said ink carried on said ink carrier to transfer said ink onto a print medium;

a memory associated with said ink carrier device having a print parameter set stored therein, said print parameter set comprising a plurality of different partial parameter sets respectively for different print image types;

a processing unit connected to said print head and being placed in communication with said memory when said ink carrier device is in said position, said processing unit reading out said print parameter set from said memory and determining, for a printing element of said print head, a control quantity specifically relevant to melting, by said printing element of said print head, said ink carried by said ink carrier of said ink carrier device, using the respective partial parameter set for a print image type to be printed in a current activation of said print element; and said processing unit controlling activation of said print element of said print head using said control quantity to cause said print element of said print head to melt said ink to transfer said ink to said print medium.

* * * * *